United States Patent [19]

Sugiura et al.

[11] 4,190,687

[45] Feb. 26, 1980

[54] METHOD FOR TREATING LEATHER

[75] Inventors: Takahisa Sugiura, Takatsuki; Sadaharu Abeta, Toyonaka; Takashi Kato, Amagasaki; Hiroshi Hotta, Muko, all of Japan

[73] Assignee: Sumitomo Chemical Company, Limited, Osaka, Japan

[21] Appl. No.: 844,126

[22] Filed: Oct. 20, 1977

Related U.S. Application Data

[63] Continuation of Ser. No. 690,181, May 26, 1976, abandoned, which is a continuation of Ser. No. 357,658, May 7, 1973, abandoned.

[30] Foreign Application Priority Data

May 9, 1972 [JP] Japan ..... 47-46041
Oct. 4, 1972 [JP] Japan ..... 47-100115
Oct. 5, 1972 [JP] Japan ..... 47-100207

[51] Int. Cl.[2] ..... B05D 3/02

[52] U.S. Cl. ..... 427/389; 8/94.1 R; 428/540

[58] Field of Search ..... 8/73, 94.1, 94.21, 115.6; 427/389; 428/423, 425, 473, 474, 520, 523, 540, 904

[56] References Cited

U.S. PATENT DOCUMENTS

| | | | |
|---|---|---|---|
| 2,828,223 | 3/1958 | McWherter | 427/389 |
| 2,884,340 | 4/1959 | Loshaek | 428/473 X |
| 3,048,496 | 8/1962 | Buechler et al. | 428/473 |
| 3,082,184 | 3/1963 | Falgiatore et al. | 260/30.4 |
| 3,231,420 | 1/1966 | Lowell et al. | 428/473 |
| 3,269,854 | 8/1966 | Mattei | 428/473 X |
| 3,291,558 | 12/1966 | Bader et al. | 8/94.21 |
| 3,310,428 | 3/1967 | Maloney | 428/473 |
| 3,345,203 | 10/1967 | Kine et al. | 428/473 X |
| 3,400,173 | 9/1968 | Reischl | 260/859 |
| 3,642,936 | 2/1972 | Hodge et al. | 260/827 |
| 3,677,813 | 7/1972 | Eckert et al. | 428/473 |
| 4,000,958 | 1/1977 | Hirooka et al. | 427/389 |

FOREIGN PATENT DOCUMENTS

| | | | |
|---|---|---|---|
| 1174937 | 7/1964 | Fed. Rep. of Germany . | |
| 1236202 | 3/1967 | Fed. Rep. of Germany . | |
| 2051569 | 4/1972 | Fed. Rep. of Germany . | |
| 2160379 | 6/1973 | Fed. Rep. of Germany | 427/389 |
| 651420 | 4/1951 | United Kingdom . | |
| 938142 | 10/1963 | United Kingdom . | |
| 956799 | 4/1964 | United Kingdom . | |
| 1072723 | 6/1967 | United Kingdom . | |
| 1188404 | 4/1970 | United Kingdom . | |

*Primary Examiner*—P. E. Willis, Jr.
*Attorney, Agent, or Firm*—Stevens, Davis, Miller & Mosher

[57] ABSTRACT

Leather can be protected from color bleeding and, at the same time, the surface gloss and smoothness of a leather can be controlled to any desired value by treating the leather, which has been colored with dyes or pigments, with a copolymer (I) comprising (B) an ethylenically unsaturated ester compound having 4 to 22 carbon atoms and (A) an ethylenically unsaturated hydrocarbon compound having 2 to 20 carbon atoms or a halogen-substituted derivative thereof and, if necessary, a third component which is a vinyl compound having a functional group; or with a mixture of 100 parts by weight of said copolymer (I) and 0.1 to 100 parts by weight of a polymer of copolymer (II) of an ethylenically unsaturated compound and/or 0.1 to 100 parts by weight of an inorganic powder (III).

36 Claims, No Drawings

METHOD FOR TREATING LEATHER

This is a Continuation of application Ser. No. 690,181 filed May 26, 1976 which in turn is a Continuation of Ser. No. 357,658, filed May 7, 1973, both abandoned.

This invention relates to a method for treating a leather, and, more particularly, to a method for preventing the color bleeding of a leather colored with a dye or pigment, and also to a method for controlling the surface gloss and a texture such as, smoothness, and the like, of the leather.

In coating a leather, it is required that a proper combination of physical properties and chemical properties is imparted to the leather. The primary requirement for the coating is to provide the leather with protective functions, that is, resistance to abrasion, moisture, alcohol, gasoline, grease, acids, alkalis, salts, heat, and light. Decorative function is also important to leather. That is to say, such properties as gloss, smoothness, and shade, are greatly significant in this field.

There has already been known a method for imparting the above-mentioned functions, which comprises treating a leather with a solution containing polyurethane, nylon, or amino acid resins as the major component. Such a treatment succeeded in many instances in imparting desired properties to leathers, but had a disadvantage that it was impossible to inhibit sufficiently the phenomenon of bleeding of dyes or organic pigments, when applied to natural, artificial or synthetic leathers dyed with dyes such as acid dyes, metal-containing dyes, oil-soluble dyes, and reactive dyes, or high-grade pigments for imparting thereto a vivid and transparent tone which is the recent trend in the field of leather coloring. The above color bleeding phenomenon brings about such a trouble that when a piece of conventionally treated leather is placed on another, and a pressure is applied to the resulting assembly, the colorant in each piece migrates to the other and extremely stains the faces. Such a phenomenon actually occurs when pieces of leather placed one on another are sewn or when a large number of leather pieces are allowed to stand put one on another.

Under these circumstances, advent of a method for treating a leather, which is capable of imparting various properties required for a leather surface and, simultaneously, of rendering the leather surface resistant to color bleeding, has been eagerly awaited. In order to achieve such an object, the present inventors have conducted extensive research and, as a result, have found that the above object can be achieved by treating a leather with a copolymer (I) comprising (B) an ethylenically unsaturated ester compound having 4 to 22 carbon atoms and (A) an ethylenically unsaturated hydrocarbon compound having 2 to 20 carbon atoms or a halogen-substituted derivative thereof, as the principal components.

The copolymer used in this invention includes widely copolymers (I) comprising as the principal components (B) an ethylenically unsaturated ester compound having 4 to 22 carbon atoms and (A) an ethylenically unsaturated hydrocarbon compound having 2 to 20 carbon atoms or a halogen-substituted derivative thereof. Accordingly, not only copolymers obtained by direct copolymerization of both components but also graft copolymers obtained by grafting (B) and/or (A) on the polymers or copolymers of (A) and/or (B) are included in the category of this invention. Although satisfactory results in preventing color bleeding can be obtained by treating the leather surface with a copolymer consisting of the above-said two components, the performance characteristics of the copolymer, such as adhesion to leather and solvent resistance are improved by further introducing into the copolymer one or more other reactive monomers by copolymerization or polymer reaction. These modified copolymers are also included in the copolymer in this invention. In short, a particularly important point in this invention is that a polymer, in which both of the ester compound and the hydrocarbon compound or halohydrocarbon compound are simultaneously present, is highly effective in preventing color bleeding.

As for the ratio of (B) and (A) in the copolymer in this invention, a copolymer containing 0.1 to 10 moles of (A) per mole of (B) results in an excellent effect. A multi-component copolymer having a third component introduced thereinto gives desirable results when the third component is used in an amount of 0.01 to 30 mole percent.

The ethylenically unsaturated ester compounds for use in this invention are those having 4 to 22 carbon atoms including both esters of unsaturated carboxylic acids and unsaturated esters of carboxylic acids. These compounds are preferably esters of aliphatic carboxylic acids, aromatic carboxylic acids, cycloaliphatic carboxylic acids, mixtures of these acids, or halogen-substituted derivatives of these acids. Preferable alcohol moieties of the ester are hydrocarbon radicals and halohydrocarbon radicals such as, for example, alkyl, aryl, aralkyl, alkylaryl, cycloalkyl, alkenyl, aralkenyl, alkenylaryl, cycloalkenyl radicals, and halogen-substituted derivatives thereof. Favorable results are most easily obtained with esters of unsaturated acids such as, for example, acrylic esters, methacrylic esters, crotonic esters, itaconic esters, maleic esters, fumaric esters, and the like. Particularly preferred are acrylic esters and methacrylic esters.

These compounds include specifically, for example, methyl acrylate, ethyl acrylate, butyl acrylate, octyl acrylate, stearyl acrylate, methyl methacrylate, ethyl methacrylate, butyl methacrylate, octyl methacrylate, stearyl methacrylate, ethyl crotonate, diethyl itaconate, diethyl maleate, diethyl fumarate, chloromethyl acrylate, chloroethyl acrylate, chloromethyl methacrylate, chloroethyl methacrylate, and the like.

Unsaturated esters of carboxylic acids which are the other group of the unsaturated ester compounds include esters containing vinyl, vinylidene, or vinylene radical; of these, vinyl ester compounds such as, for example, vinyl esters of fatty acids are particularly preferred. The compounds may specifically be vinyl acetate, vinyl propionate, vinyl butyrate, vinyl laurate, vinyl benzoate, vinyl norbornanecarboxylate, vinyl chloroacetate, and allyl acetate.

Ethylenically unsaturated hydrocarbon compounds and halogen-substituted derivatives thereof, which are the (A) compounds, are olefins and haloolefins having 2 to 20, preferably 3 to 20, carbon atoms, and aliphatic, aromatic, and cycloaliphatic ones are often used, either terminally or internally unsaturated compound of which may be used. Particularly preferred are aliphatic $\alpha$-olefins, particularly isobutylene and propylene. Examples of these compounds include propylene, isobutylene, ethylene, butene-1, pentene-1, 2-methylbutene-1, 2-methylpentene-1, hexene-1, butene-2, 4-methylpentene-1, 2-methyl-4-phenylbutene-1, octadecene, vinyl chloride, vinylidene chloride, β-methallyl chloride, 2-methyl-4-chloropentene-1, norbornene, indene, styrene, α-methylstyrene, vinyltoluene, α-chlorostyrene, p-chlorostyrene, and p-bromostyrene.

The copolymer (I) composed of (B) and (A) can be converted to a reactive polymer by introducing functional groups thereinto. Introduction of functional groups can be effected by copolymerization, graft copolymerization, or polymer reaction with at least one of the third components having functional groups.

As the above-mentioned functional group, there may be employed the same functional groups as those frequently used for imparting reactivity to known acrylic ester polymers, and, in addition, any of other functional groups may be introduced thereinto. Although such functional groups can be introduced into the copolymer (I) in any proportion, particularly favorable results are obtained when they are introduced in such a proportion that 0.01 to 30, preferably 0.1 to 10, mole percent of the functional groups may be present in the copolymer (I). The polymers containing these functional groups react when subjected to the action of heat, light, water, or other reagents, or crosslink on simple removal of the solvent and are thus useful for improving durability and other properties.

Typical examples of the functional compounds employed in this invention are vinyl compounds having 3 to 40 carbon atoms which have an acid halide, amide, carboxyl, acid anhydride, nitrogen-containing heterocyclic, nitrile, or aldehyde group. Particularly preferred are vinyl compounds of the following general formula:

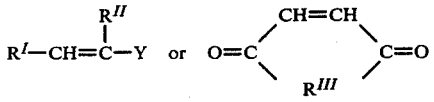

wherein Y is a residue having 1 to 20 carbon atoms which has a functional radical selected from the group consisting of acid halide, amide, carboxyl, acid anhydride, nitrogen-containing heterocyclic, nitrile, and aldehyde radicals; $R^I$ and $R^{II}$ are each hydrogen or a halogen atom, a hydrocarbon- or halohydrocarbon-residue having 1 to 8 carbon atoms, or a residue as defined above for Y; and $R^{III}$ is oxygen atom or the residue $>N—R^{IV}$, wherein $R^{IV}$ is hydrogen atom or a hydrocarbon- or halohydrocarbon-residue having 1 to 8 carbon atoms. Preferred hydrocarbon- or halohydrocarbon-residues for $R^I$, $R^{II}$ and $R^{III}$ are alkyl, alkenyl, aryl, alkylaryl, aralkyl, and cycloalkyl radicals, and halogen-substituted derivatives thereof. Preferred vinyl compounds are acrylic acid, acryloyl halides, acrylamides, maleic anhydride, maleimides, fumaric acid, acrylonitrile, vinylpyridines, acrolein, and derivatives thereof.

Examples of the monomers employed above or in combination are more concretely shown as follows: acrylic acid, methacrylic acid, crotonic acid, itaconic acid, acryloyl chloride, acryloyl bromide, acryloyl iodide, methacryloyl chloride, methacryloyl bromide, acrylamide, N-methylacrylamide, N,N-diethylacrylamide, methacrylamide, N,N-dimethylaminoethyl acrylate, maleic anhydride, maleimide, N-methylmaleimide, maleic acid monoamide, N-methylmaleic acid monoamide, maleic acid diamide, N,N'-dimethyl maleic acid diamide, fumaric acid, fumaric acid monoamide, maleic acid acrylonitrile, methacrylonitrile, maleodinitrile, fumarodinitrile, N-vinylpyridine, 2-vinylpyridine, 2-methyl-N-vinylpyridine, acrolein, methacrolein, and crotonaldehyde. Other radicals such as, for example, hydroxyl, amino, epoxy, ether, and isocyanate may also be introduced to form functional polymers which can be used in this invention. Among the aforesaid functional radicals, an acid halide and an acid anhydride are particularly useful. For example, acryloyl chloride, methacryloyl chloride, and maleic anhydride may be copolymerized.

The surface characteristics of a leather, such as gloss, smoothness, and color shade, are important for decorative functions of the leather. More and more advanced performances are being requested in the leather finishing, so it is required that the gloss and smoothness be adjustable to any desired value according to the purpose of treatment. In order to meet such requirements, the present inventors have concentrated their efforts also on improvement of the above-mentioned novel method for treating leather. As a result, it has been found that gloss and smoothness due to the copolymer (I) can be adjusted by incorporating and dispersing a different type of high molecular weight substance in the copolymer (I), and, further, that gloss and smoothness can be varied to any desired value by varying the mixing ratio of said different type of high molecular weight substance. The reason for this seems to be that phase separation takes place more or less in the mixture of different types of polymers and light scattering at the interfaces produces a matting effect. Such a phenomenon has been found in a wide range of high molecular weight substances. More surprisingly, it has also been found that when a high molecular weight substance soluble in the same solvent as for the copolymer (I) is applied together with the copolymer (I) solution, the high molecular weight substance is appropriately dispersed and phase separation takes place to enable the adjustment of gloss. It has also been found that an inorganic powder may be used together with the said different kind of high molecular weight substance in controlling gloss.

Thus, the present invention provides a method for treating a leather with a treating agent comprising a mixture of a copolymer (I) comprising as the principal components an ethylenically unsaturated ester compound having 4 to 22 carbon atoms and an ethylenically unsaturated hydrocarbon compound having 2 to 20 carbon atoms or a halogensubstituted derivative thereof and 0.1 to 100 parts by weight, per 100 parts by weight of the copolymer (I), of a polymer (II) having in the main molecular chain a structural unit selected from the group consisting of

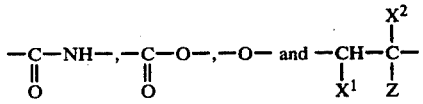

wherein $X^1$, $X^2$ and Z are hydrogen atoms, halogen atoms, or radicals selected from R, $R^1$, and $R'Y^1$, where $Y^1$ is a radical selected from

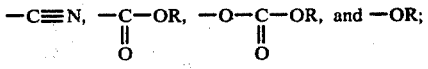

R is a hydrocarbon- or halohydrocarbon-radical having 1 to 20 carbon atoms; and R' is a divalent hydrocarbon or halohydrocarbon-radical having 1 to 20 carbon atoms, provided that at least one of $X^1$ and $X^2$ is hydrogen, or a mixture of (I), (II) and 0.1 to 100 parts by weight, per 100 parts by weight of the copolymer (I), of an inorganic powder (III). By using the method for treating a leather according to this invention, it is possible to form a surface film having any desired gloss in accordance with the taste and the intended end use for the leather, together with various characteristic properties necessary for the surface film of leather while retaining, of course, the ability to prevent bleeding of a colorant, which is one of the characteristic features of the present method for treating a leather.

As the polymer (II), there may generally be used a polymer having a mean molecular weight of 2,000 or more. Polymers of the general formula

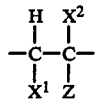

include polymers and copolymers of ethylenically unsaturated compounds and, specifically, useful are polymers and copolymers of aliphatic, aromatic, and cycloaliphatic olefins and haloolefins, esters of unsaturated carboxylic acids, unsaturated esters of carboxylic acids, unsaturated ether, nitrile radical-containing olefins, and nitrile radical-containing haloolefins. Polymers having the group

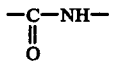

in the main molecular chain are preferably polyamides, polyurethanes, polyureas, and polyamino acids. As polymers having the group

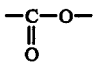

in the main molecular chain, there may be employed polyesters and polycarbonates. Polymers having the ether linkage in the main molecular chain include polyethers and polyacetals. The polymers (II) may contain in the structure any one of the units represented by the above-mentioned formulas, or may contain two or more of these units in the same structure. Accordingly, the family of the polymers (II) includes block polymers and graft polymers. Examples of particularly useful polymers and copolymers included in the polymer (II) are those of ethylene, propylene, isobutylene, pentene-1, 4-methylpentene-1, vinyl chloride, vinylidene chloride, butadiene, chloroprene, isoprene, styrene, α-methylstyrene, vinyltoluene, α-chlorostyrene, p-chlorostyrene, p-bromostyrene, methyl acrylate, butyl acrylate, stearyl acrylate, methyl methacrylate, butyl methacrylate, stearyl methacrylate, ethyl crotonate, diethyl itaconate, diethyl maleate, vinyl acetate, vinyl propionate, vinyl laurate, vinyl benzoate, vinyl chloroacetate, allyl acetate, methyl vinyl ether, 2-chloroethyl vinyl ether, acrylonitrile, and methacrylonitrile. Other polymers (II) often used are ring scission polymers of ε-caprolactam and the like; condensation polymers of diamines such as ethylenediamine and hexamethylenediamine with dicarboxylic acids such as adipic acid and sebacic acid; addition polymers of ethylene glycol-adipic acid polymers or propylene glycolsuccinic acid polyester to 1,5-naphthylene diisocyanate, diphenylmethane diisocyanate, or 2,4-tolylene diisocyanate; condensation polymers of amino acids, such as γ-methylglutamic acid, or derivatives thereof; condensation polymers of ethylene glycol or 1,4-butanediol with terephthalic acid or adipic acid; polycarbonates derived from bisphenol A and the like; polyethers, that is, polymers of ethylene oxide, propylene oxide, 1,4-butanediol, and phenol; and acetals derived from aldehydes. The polymer (II), includes specifically, for example, polystyrene, poly-p-chlorostyrene, polyacrylonitrile, polymethyl acrylate, polymethyl methacrylate, polyvinyl acetate, poly(2-chloroethyl vinyl ether), polyvinyl chloride, polyvinylidene chloride, polybutadiene, polyisoprene, polychloroprene, ethylene-vinyl acetate copolymer, ethylene-ethyl acrylate copolymer, styrene-methyl methacrylate copolymer, styrene-acrylonitrile copolymer, isobutylene-isoprene copolymer, styrene-butadiene copolymer, acrylonitrile-butadiene copolymer, polybutadiene-styrene graft-copolymer, polybutadiene-methyl methacrylate-styrene graft-copolymer, polybutadiene-acrylonitrile-styrene graftcopolymer, styrene-butadiene block-copolymer, 6-nylon, 6,10-nylon, urethane prepared from ethylene glycol-succinic acid polyester and 2,4-tolylene diisocyanate, urethane prepared from 1,2-propylene glycol-succinic acid polyester and diphenylmethane diisocyanate, and poly(γ-methyl glutamate), and these produce preferable results.

Further, the polymer (II) can be converted to a reactive polymer by introduction of functional groups. Introduction of functional groups may be effected by copolymerization, graft polymerization, or polymer reaction with at least one monomer having a functional group. For the said functional group, there may be employed the same functional groups as those commonly used for imparting reactivity to known acrylic ester polymers, and, in addition, any of the other functional groups may also be used.

Although such functional groups may be introduced into the polymer (II) in any proportion, particularly favorable results are obtained when the functional groups are introduced in a proportion of 0.01 to 30, preferably 0.1 to 10 mole percent of the polymer (II). The polymers having these functional groups react when subjected to the action of heat, light, water, or other reagents, or crosslink on simple removal of the solvent, whereby the durability and other properties of the polymer (II) are usefully improved.

The inorganic powder (III) is not limited to any particular substance, but above all silica gel, aluminum oxide, titanium oxide, and calcium carbonate give favorable results. The particle diameter of the powder is 1 mμ to 50μ, preferably 1μ to 10μ.

The method for preparing the copolymer (I) and polymer (II) is already well known from the literature and is not needed to be explained in detail herein. Most of them can be prepared by radical polymerization and, if necessary, by ionic polymerization. Any type of polymerization procedures such as mass polymerization, solution polymerization, emulsion polymerization and suspension polymerization may be used with some exceptions depending upon the type of catalyst and monomer. For instance, when the catalyst or the monomer reacts with or is decomposed by water, polymerization must be carried out in the absence of water. Some of the polymers (II) are synthesized by ring scission polymerization, condensation polymerization, or addition polymerization. Preparation of these polymers is already disclosed in the literature and, accordingly, is not explained herein. A particularly preferable method for polymerizing ethylenically unsaturated compounds is that in which a radical-generating catalyst is used. For this purpose, any of peroxides, oxygen, azo compounds, heat light, radiation, and organomethallic compounds may be suitably used. A suitable redox catalyst system is also frequently used. In copolymerizing an olefin, which is difficult to polymerize with a radical initiator owing to degenerative chain transfer, with an unsaturated ester compound, good results tend to be obtained by addition of a Lewis acid such as a metal halide. Excellent are halides of elements of Groups II*b*, III*b*, IV*b*, V*b*, and VIII of the Mendeleev Periodic Table, particularly compounds ofaluminium, boron, zinc, and tin. An alternating copolymer can be obtained with organoaluminum halides, organoboron halides, or equivalent compounds used as catalyst components. The alternating copolymer is preferably used in the method of this invention.

The molecular weight of the copolymer (I) has no particular restriction, but a suitable copolymer has an intrinsic viscosity of 0.1 to 10 dl/g, particularly 0.2 to 3 dl/g, most preferably 0.5 to 2 dl/g., as measured in toluene at 30° C.

Treatment of leather by using the treating agent of this invention can be carried out in any convenient way, but a particularly preferred procedure is coating with a solution of the agent dissolved in a solvent. As the solvent, there may be used preferably aromatic hydrocarbons, halohydrocarbons, ketones, ethers, esters, and amides, such as, for example, benzene, xylenes, perchloroethylene, trichloroethylene, acetone, methyl ethyl ketone, ethyl acetate, tetrahydrofuran, cyclohexanone, dimethylformamide, etc. Although the solution is not limited in concentration, a suitable solution has a concentration of 1 to 50% by weight, preferably 5 to 30% by weight and a viscosity of 10 to 100,000 centipoises, particularly 100 to 1,000 centipoises. The copolymer (I), polymer (II), and inorganic powder (III) can be mixed by dissolving or dispersing directly in a solvent, or, alternatively, separately prepared solutions or dispersions can be mixed. The solvents to be used for (I), (II), and (III) may be common to or compatible with one another, though not necessarily be compatible. The treating liquid is prepared by adding (II) to (I) or adding (II) and (III) to (I) in a proportion according to the purpose of application, and stirring them thoroughly. The resulting liquid is applied to a leather by any of the conventional methods such as brush coating, spraying, dipping, or knife coating, in a proportion of 0.01 to 100 g, preferably 1 to 50 g, in terms of solids per square meter, and then dried at a temperature of from room temperature to 200° C. Alternatively, aqueous or oily dispersions of the copolymer (I), the polymer (II), and the inorganic powder (III) may be applied, or the copolymer (I), the polymer (II) and the inorganic powder may be melted and applied as such as in hot-melting.

The film thus formed has excellent performance characteristics requisite to a leather surface, together with suitable gloss and smoothness. When a copolymer (I) having a cross-linkable group and/or a polymer (II) having a cross-linkable group is used, a further improvement in performance characteristics such as adhesion to leather, solvent resistance, and moisture resistance is obtained.

By proper selection of the type and amount of the polymer (II) and the type of solvent in preparing the leather treating liquid, a mixture of the solution of (II) and the solution of (I) can be allowed to become an opaque state through the respective solutions are alone colorless, transparent and homogeneous. The more opaque the treating liquid, the duller the film obtained when the surface of leather is treated with the liquid.

That the leather which has been treated by the method of this invention has an improved color bleeding property is one of the characteristic features of this invention, and the colorants that can be protected from bleeding include practically all of dyes and organic pigments. As the dyes, there may be exemplified direct dyes, acid dyes, metal-containing dyes, cationic dyes, oil-soluble dyes, reactive dyes, and dispersion dyes, among others. Of these, metal-containing dyes, acid dyes, and oil-soluble dyes are preferably used.

The term "leather" used herein means a natural leather and a leather comprising a synthetic high polymer substance. Preferable for the method fo this invention are natural leathers and leathers made of synthetic high molecular weight substances having a surface layer comprising the —HNCO— linkage as the principal component. The grain layer may be the same as or different from the surface layer in chemical composition. Accordingly, the method of this invention is applicable not only to natural leather, polyurethane leather, polyamide leather, and amino acid leather themselves, but also to the natural leather, polyamide leather, amino acid leather, polyurethane leather, vinyl chloride leather, and the like which are covered with a colored surface layer comprising the —HNCO— linkage as the principal component.

The invention is illustrated below with reference to Examples, but the scope of the invention is not limited to the Examples. In the Examples, parts and percent are by weight unless otherwise specified.

EXAMPLE 1

An isobutylene-methyl acrylate-acryloyl chloride copolymer (composition in mole percent: 48.9/44.4/6.7) prepared by direct copolymerization of isobutylene, methyl acrylate and acryloyl chloride was dissolved in toluene to prepare a solution containing 10% by weight of the resin.

The solution obtained above was applied with a brush on a leather having a surface layer of polyurethane, in which "Suminol Milling Red G" (CI No. Acid Red 158) (registered trademark of Sumitomo Chemical Co., Ltd.) has been used as a colorant, and dried at 50° C. for 10 minutes.

The resin was applied at a rate of 2 g in terms of solids per square meter. After having been treated, the leather still retained its pliability, had a good gloss, and was resistant to perchloroethylene, toluene and methyl ethyl ketone. On testing, the leather showed a color bleed rating of 5, while that of an untreated leather was 1. A leather treated with polymethyl acrylate under the same conditions for comparison showed a color bleed rating of 2.

The testing method for color bleeding was as follows: A colored leather treated with a copolymer for use in this invention and an untreated white leather are placed one on the other and face to face, and allowed to stand for 24 hours under a load of 100g/cm$^2$ in an atmosphere at a temperature of 70° C. and a relative humidity of 65%. Then, the density of the color transferred from the colored leather to the white leather by bleeding is assessed by comparison with the gray scale for assessing staining (JIS L 0805—1965). The rating ranges from 1 to 5, and larger numerical values show more reduced color bleeding. The same testing method applies to other Examples.

EXAMPLE 2

An isobutylene-ethyl acrylate-acryloyl chloride copolymer (composition in mole percent: 49.3/45.5/5.2) obtained by direct copolymerization in a manner similar to that in Example 1 was dissolved in perchloroethylene to prepare a 10%-solution. The solution was applied with a brush on an amino acid leather having a surface layer of an amino acid resin, which had been colored with "Lanyl Red GG" (CI No. Acid Red 211) (registered trademark of Sumitomo Chemical Co., Ltd. for a metal complex dye (1:2 type)), and dried at 100° C. for 5 minutes. The resin was applied at a rate of 3 g in terms of solids per square meter. After having been treated, the leather had good gloss, and was resistant to solvents such as perchloroethylene, toluene, and methyl ethyl ketone. The color bleed rating was 5, while that of an untreated leather was 1. A leather treated with polyethyl acrylate under the same conditions showed a color bleed rating of 2.

EXAMPLE 3

A propylene-methyl acrylate-acryloyl chloride copolymer obtained by direct copolymerization of the monomers (composition in mole percent: 41.4/47.4/11.2) was dissolved in toluene to prepare a 10%-solution. The solution was applied with a brush on a polyurethane leather with a nylon surface layer which had been colored with a solvent-type dye "Spirit Black No. 850" (CI No. Solvent Black 5) (trade mark of Sumitomo Chemical Co., Ltd.), and dried at 50° C. for 10 minutes. The resin was applied at a rate of 4 g/m$^2$ in terms of solids. On testing, the treated leather showed a color bleed rating of 5, while untreated leather showed a rating of 1.

EXAMPLE 4

A treating liquid was prepared by mixing and dispersing 6 parts of a 5%-toluene dispersion of "Aerosil 200" (trademark for silica powder of Nippon Aerosil Co., Ltd.) in 94 parts of a 10%-toluene solution of an isobutylene-methyl acrylate-acryloyl chloride copolymer (composition in mole percent: 48.9/44.4/6.7) which was the same as used in Example 1. The treating liquid was applied by means of a brush on a polyurethane artificial leather which had been colored with "Suminol Milling Black B" (CI No. Acid Black 109), and dried at 100° C. for 2 minutes. The resin was applied at a rate of 2.0 g in terms of solids per square meter. The color bleed rating was 5, while that of an untreated leather was 1. The reflectance was 30.2%.

The reflectance of an untreated leather was 59.2%, while that of a leather treated with a treating composition containing only the copolymer and no silica powder (the application rate being 2.3 g in terms of solids per square meter) was 78.1%.

The reflectance mentioned above was measured at an angle of incidence of 75° and at an angle of reflexion of 75° by using a gloss tester, "Glossmeter". Reflectance is indicative of the matting effect. The same testing method shall apply hereinafter.

EXAMPLES 5 TO 12

The copolymer solutions shown in Table 1 were applied on various leathers colored with various dyes shown in Table 1 at the application rates shown in the same Table, and dried with heating. After having been treated, the leathers showed a smooth surface with good gloss. The treated leathers in Examples 10 to 12 were resistant to solvents such as perchloroethylene and toluene.

Table 1

| Example No. | Copolymer | | Copolymer solution | | Leather | | Heating | | Application rate (as solids, g/m$^2$) | Color bleed test | |
|---|---|---|---|---|---|---|---|---|---|---|---|
| | Type | Composition (mol.-%) | Solvent | Conc. (% by wt.) | Surface resin | Dye used | Time (min.) | Temp. (°C.) | | Treated | Untreated |
| 5 | Styrene-ethyl acrylate | 45/55 | Acetone | 10 | Urethane | Suminol Milling Red *1 | 10 | 50 | 4 | 4–5 | 1 |
| 6 | Vinyltoluene-2-ethylhexyl methacrylate | 49/51 | Toluene | 10 | Nylon | Suminol Milling Red *1 | 5 | 100 | 5 | 3–4 | 1 |
| 7 | Isobutylene-methyl acrylate | 50/50 | " | 15 | " | Suminol Milling Red *1 | 3 | 100 | 4 | 4–5 | 1 |
| 8 | Ethylene-vinyl acetate | 78/22 | " | 10 | Urethane | Lanyl Red GG *2 | 3 | 100 | 4 | 3 | 1 |
| 9 | Vinyl chloride-n-butyl acrylate | 30/70 | " | 8 | Amino acid resin | Lanyl Red GG *2 | 3 | 120 | 4 | 4–5 | 1 |
| 10 | Isobutylene-methyl acrylate-acrylic acid | 50/47/3 | " | 10 | Urethane | Lanyl Red GG *2 | 10 | 100 | 4 | 5 | 1 |
| 11 | Styrene-n-butyl acrylate-N-hydroxymethylacrylamide | 23/69/8 | Methyl ethyl ketone | 15 | " | Suminol Milling Black B *3 | 5 | 120 | 4 | 4–5 | 1 |
| 12 | Styrene-n-butyl acrylate-glycidyl methacrylate | 23/69/8 | Toluene | 10 | " | Suminol Milling Black B | 3 | 110 | 4 | 4–5 | 1 |

Table 1 -continued

| Example No. | Copolymer: Type | Copolymer: Composition (mol.-%) | Copolymer solution: Solvent | Copolymer solution: Conc. (% by wt.) | Leather: Surface resin | Leather: Dye used | Heating: Time (min.) | Heating: Temp. (°C.) | Application rate (as solids, g/m²) | Color bleed test: Treated | Color bleed test: Untreated |
|---|---|---|---|---|---|---|---|---|---|---|---|
| | | | | | | *3 | | | | | |

Note:-
*1 Trademark of Sumitomo Chemical Co., Ltd., CI No. Acid Red 158
*2 Trademark of Sumitomo Chemical Co., Ltd., CI No. Acid Red 211
*3 Trademark of Sumitomo Chemical Co., Ltd., CI No. Acid Black 109

EXAMPLE 13

A treating liquid was prepared by mixing and dispersing 5 parts of a 5%-toluene dispersion of "Aerosil 200" in 95 parts of a 10%-toluene solution of the same isobutylene-methyl acrylate-acrylic acid copolymer as used in Example 10. The treating composition was applied on a polyurethane artificial leather colored with "Suminol Milling Black B" (CI No. Acid Black 109), and dried at 100° C. for 2 minutes. The application rate was 4 g in terms of solids per square meter.

The color bleed rating was 5, while that of an untreated leather was 1. The reflectance was 35%, while that of an untreated leather was 60%, and that of a leather treated with a treating liquid containing only the copolymer and no silica powder (the application rate being 3 g in terms of solids per square meter) was 80%.

EXAMPLES 14 TO 23

Treating liquids were prepared by mixing respective components in respective proportions as shown in Table 2. These treating liquids were applied by means of a brush on the polyurethane artificial leather colored with "Suminol Milling Black B" (CI No. Acid Black 109) (registered trademark of Sumitomo Chemical Co., Ltd.), and dried at 100° C. for 2 hours.

Color bleed ratings and reflectances of the leather thus treated were as shown in Table 3.

Table 2

| Ex. No. | Copolymer (I) Solution: Copolymer (I): Type | Copolymer (I): Composition (wt.-%) | Solvent/conc. of solution (wt.-%) | Parts by wt. | Polymer (II) Solution: Polymer (II) (Trademark/manufacturer) | Solution: Solvent | Solution: Conc. (wt.-%) | Parts by wt. | Inorganic powder (III) dispersion: Inorganic powder (III) | Conc. of toluene dispersion (wt.-%) | Parts by wt. |
|---|---|---|---|---|---|---|---|---|---|---|---|
| 14 | Isobutylene-methyl acrylate-acryloyl chloride | 49/44/7 | Toluene /10 | 90 | Polystyrene (Esbrite GP, Nihon Polystyrene) | Toluene | 10 | 10 | — | — | — |
| 15 | Isobutylene-methyl acrylate-acryloyl chloride | " | " | 85 | Polymethyl methacrylate (Sumiper-MG, Sumitomo Chemical) | " | 10 | 15 | — | — | — |
| 16 | Isobutylene-ethyl acrylate | 50/50 | " | 80 | Ethylene-vinyl acetate copolymer (Evertate R 5010, Sumitomo Chem.) | " | 10 | 18 | Silica gel ("Aerosil/200" Nippon Aerosil) | 5 | 2 |
| 17 | Isobutylene-methyl acrylate-acrylic acid | 50/47/3 | " | 95 | Polymethyl methacrylate | " | 10 | 5 | — | — | — |
| 18 | Vinyltoluene-2-ethylhexyl methacrylate | 49/51 | " | 90 | Polystyrene | " | 10 | 7 | Silica gel | 5 | 3 |
| 19 | Isobutylene-methyl acrylate-acryloyl chloride | 49/47/4 | " | 80 | Polyvinyl chloride (Sumilit SX-7 GL, Sumitomo Chemical) | Tetrahydrofuran | 10 | 20 | — | — | — |
| 20 | Isobutylene-methyl acrylate-acryloyl chloride | " | " | 85 | Polybutadiene-methyl methacrylate-styrene graft copolymer (Kaneace B-11, Kanegafuchi Chem.) | Toluene | 10 | 15 | — | — | — |
| 21 | Isobutylene-methyl acrylate | 49/51 | " | 85 | Polyamide (Honeytop 712, Honey Chem.) | Methanol/toluene/dichloroethane | 9 | 15 | — | — | — |
| 22 | Isobutylene-methyl acrylate | " | Dimethylformamide/10 | 80 | Polyurethane (Sunprene LQ-X 35BL, Sanyo Chem.) | Dimethylformamide | 10 | 20 | — | — | — |
| 23 | Isobutylene-methyl acrylate | " | Dichloro- | 82 | Polyamino acid (PLG-20, Kyowa | Dichloroethane | 10 | 18 | — | — | — |

Table 2 -continued

| Ex. No. | Copolymer (I) Solution: Copolymer (I) Type | Copolymer (I) Composition (wt.-%) | Solvent/ conc. of solution (wt.-%) | Parts by wt. | Polymer (II) Solution: Polymer (II) (Trademark/manufacturer) | Solution: Solvent | Solution: Conc. (wt.-%) | Parts by wt. | Inorganic powder (III) dispersion: Inorganic powder (III) | Conc. of toluene dispersion (wt.-%) | Parts by wt. |
|---|---|---|---|---|---|---|---|---|---|---|---|
| | | | eth-ane/10 | | Hakko) | | | | | | |

Table 3

| Example No. (Treating composition No.) | Application rate (as solids) ($g/m^2$) | Color bleed rating | Reflectance (%) |
|---|---|---|---|
| Untreated | | 1 | 59 |
| No. 14 | 1.5 | 5 | 47 |
| No. 14, (II) omitted | 2.3 | 5 | 78 |
| No. 15 | 3.3 | 5 | 43 |
| No. 16 | 1.4 | 5 | 31 |
| No. 16, (II) and (III) omitted | 2.1 | 5 | 77 |
| No. 17 | 2.0 | 5 | 58 |
| No. 17, (II) omitted | 2.5 | 5 | 79 |
| No. 18 | 2.5 | 3–4 | 44 |
| No. 18, (II) and (III) omitted | 2.8 | 5 | 80 |
| No. 19 | 4.0 | 5 | 58 |
| No. 20 | 4.1 | 5 | 46 |
| No. 21 | 2.3 | 4–5 | 45 |
| No. 21, (II) omitted | 2.0 | 4–5 | 75 |
| No. 22 | 2.5 | 4–5 | 40 |
| No. 23 | 2.1 | 4–5 | 43 |

What is claimed is:

1. A method for treating a colored leather, which comprises treating a colored leather with a copolymer (I) consisting essentially of as the principal components (B) a monoethylenically unsaturated ester compound having 4 to 22 carbon atoms and (A) an aliphatic olefin having 3 to 20 carbon atoms.

2. A method according to claim 1, wherein the copolymer (I) comprises as a third component a vinyl compound having 3 to 40 carbon atoms and an acyl halide radical, amide radical, carboxyl radical, acid anhydride radical, nitrogen-containing heterocyclic radical, nitrile radical, or aldehyde radical.

3. A method according to claim 2, wherein the vinyl compound is a compound represented by the formula,

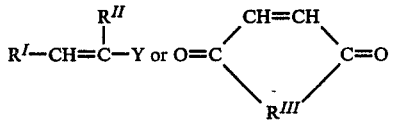

wherein Y is a residue having 1 to 20 carbon atoms and a functional radical selected from the group consisting of acyl halide, amide, carboxyl, acid anhydride, nitrogen-containing heterocyclic, nitrile, and aldehyde radicals; $R^I$ and $R^{II}$ are each hydrogen or a halogen atom, a hydrocarbon- or halohydrocarbon-residue having 1 to 8 carbon atoms, or a residue as defined above for Y; and $R^{III}$ is oxygen atom or a residue of the formula >N—$R^{IV}$ wherein $R^{IV}$ is hydrogen atom or a hydrocarbon- or halohydrocarbon-residue having 1 to 8 carbon atoms.

4. A method according to claim 2, wherein the vinyl compound is selected from the group consisting of acrylic acid, acryloyl halides, acrylamides, maleic anhydride, maleimides, fumaric acid, acrylonitrile, vinylpyridines, acrolein, and halogen-substituted derivatives of these compounds.

5. A method according to claim 2, wherein the vinyl compound is acryloyl chloride, methacryloyl chloride, or maleic anhydride.

6. A method according to claim 2, wherein the third component is contained in the copolymer (I) in a proportion of 0.01 to 30 mole percent.

7. A method according to claim 1, wherein the component (B) is an ester of an aliphatic carboxylic acid, an aromatic carboxylic acid, a cycloaliphatic carboxylic acid, or a mixture of these acids, or a halogen-substituted derivative of these acids.

8. A method according to claim 7, wherein the alcohol moiety of the ester is selected from the group consisting of alkyl, aryl, aralkyl, alkylaryl, cycloalkyl, alkenyl, aralkenyl, alkenylaryl, and cycloalkenyl radicals, and halogen-substituted derivatives of these radicals.

9. A method according to claim 1, wherein the component (B) is an ester of an unsaturated carboxylic acid.

10. A method according to claim 9, wherein the ester of an unsaturated carboxylic acid is selected from the group consisting of acrylic esters, methacrylic esters, crotonic esters, itaconic esters, maleic esters, and fumaric esters.

11. A method according to claim 9, wherein the ester of an unsaturated carboxylic acid is an acrylic ester or a methacrylic ester.

12. A method according to claim 9, wherein the ester of an unsaturated carboxylic acid is selected from the group consisting of methyl acrylate, ethyl acrylate, butyl acrylate, octyl acrylate, stearyl acrylate, methyl methacrylate, ethyl methacrylate, butyl methacrylate, octyl methacrylate, stearyl methacrylate, ethyl crotonate, diethyl itaconate, diethyl maleate, diethyl fumarate, chloromethyl acrylate, chloroethyl acrylate, chloromethyl methacrylate, and chloroethyl methacrylate.

13. A method according to claim 1, wherein the component (B) is an unsaturated ester of a carboxylic acid.

14. A method according to claim 13, wherein the unsaturated ester of a carboxylic acid is an ester containing vinyl, vinylidene, or vinylene radical.

15. A method according to claim 14, wherein the unsaturated ester of a carboxylic acid is vinyl acetate, vinyl propionate, vinyl butyrate, vinyl laurate, vinyl benzoate, vinyl norbornanecarboxylate, vinyl chloroacetate, or allyl acetate.

16. A method according to claim 1, wherein the component (A) is an aliphatic mono-α-olefin.

17. A method according to claim 1, wherein the component (A) is propylene, isobutylene, butene-1, pentene-1, 2-methylbutene-1, 2-methylpentene-1, hexane-1, butene-2, 4-methylpentene-1, 2-methyl-4-phenylbutene-1, octadecene, α-chlorostyrene.

18. A method according to claim 1, wherein the component (A) is propylene or isobutylene.

19. A method according to claim 1, wherein the copolymer (I) contains the component (A) and the component (B) in a ratio of 0.1 to 10 moles of the component (A) per mole of the component (B).

20. A method according to claim 1, wherein the copolymer (I) has an intrinsic viscosity of 0.1 to 10 dl/g as measured in toluene at 30° C.

21. A method according to claim 1, wherein the copolymer (I) is employed in solution in a solvent.

22. A method according to claim 21, wherein the solvent is an aromatic hydrocarbon, a halohydrocarbon, a ketone, an ether, an ester, or an amide.

23. A method according to claim 21, wherein the solvent is benzene, xylene, perchloroethylene, trichloroethylene, acetone, methyl ethyl ketone, ethyl acetate, tetrahydrofuran, or dimethylformamide.

24. A method according to claim 1, wherein the copolymer (I) is applied to a leather at a rate of 0.01 to 100 g as solids per square meter.

25. A method according to claim 24, wherein after application of the copolymer, the leather is dried at a temperature from room temperature to 200° C.

26. A method for treating a leather, which comprises treating a leather with a treating agent comprising 100 parts by weight of a copolymer (I) comprising as the principal components (A) an ethylenically unsaturated hydrocarbon compound having 3 to 20 carbon atoms or a halogen-substituted derivative thereof and (B) a monoethylenically unsaturated ester compound having 4 to 22 carbon atoms and 0.1 to 100 parts by weight of a polymer (II) having in the main molecular chain a structural unit selected from the group consisting of $$-\underset{\underset{O}{\|}}{C}-NH-,\ -\underset{\underset{O}{\|}}{C}-O-,\ -O-\ \text{and}\ -\underset{\underset{X^1}{|}}{CH}-\underset{\underset{Z}{|}}{\overset{\overset{X^2}{|}}{C}}-,$$

wherein $X^1$, $X^2$, and Z are hydrogen atoms, halogen atoms, or radicals selected from the group consisting of R, $Y^1$, and $R'Y^1$, where $Y^1$ is a radical selected from the group consisting of $$-C\equiv N,\ -\underset{\underset{O}{\|}}{C}-OR,\ -O-\underset{\underset{O}{\|}}{C}-OR,\ \text{and}\ -OR;$$

R is a hydrocarbon- or halohydrocarbon-radical having 1 to 20 carbon atoms; and R' is a divalent hydrocarbon- or halohydrocarbon-radical having 1 to 20 carbon atoms, provided that at least one of $X^1$ and $X^2$ is hydrogen atom, said polymer (II) being selected from the group consisting of polyamides, polyurethanes, polyureas, polyamino acids, polyesters, polycarbonates, polyethers, polyacetals, and polymers and copolymers of ethylenically unsaturated compounds which are different from copolymer (I).

27. A method according to claim 26, wherein the polymer (II) has a mean molecular weight of 2,000 or more.

28. A method according to claim 26, wherein the polymer (II) is a polyamide, polyurethane, polyurea, or polyamino acid.

29. A method according to claim 26, wherein the polymer (II) is a polymer or copolymer of an ethylenically unsaturated compound of the formula $$-\underset{\underset{X^1}{|}}{CH}-\underset{\underset{Z}{|}}{\overset{\overset{X^2}{|}}{C}}-,$$

said compound selected from the group consisting of aliphatic, aromatic and cycloaliphatic olefins and haloolefins, esters of unsaturated carboxylic acids, unsaturated esters of carboxylic acids, unsaturated ethers, olefins containing a nitrile radical, and haloolefins containing a nitrile radical, said polymer or copolymer being different from copolymer (I).

30. A method according to claim 26, wherein the treating agent further comprises a 0.1 to 100 parts by weight of an inorganic powder (III).

31. A method according to claim 30, wherein the inorganic powder (III) is a powder of silica gel, aluminum oxide, titanium oxide, or calcium carbonate.

32. A method according to claim 30, wherein the inorganic powder (III) has a particle diameter of 1 mμ to 50μ.

33. A method according to claim 26, wherein the treating agent is applied to a leather at a rate of 0.01 to 100 g in terms of solids per square meter.

34. A method according to claim 23, wherein after application of the treating agent, the leather is dried at a temperature from room temperature to 200° C.

35. A method for treating a leather, which comprises treating a surface of a leather, which is colored with a dye or a pigment, with a copolymer (I) consisting of about 30 to 50 mole percent of at least one member selected from the group consisting of isobutylene and propylene, about 20 to 70 mole percent of an acrylic ester compound containing as the alcohol moiety a hydrocarbon- or halohydrocarbon-radical having 1 to 20 carbon atoms, and about 0.1 to 30 mole percent of an acryloyl halide and/or maleic anhydride.

36. A method for treating a leather, which comprises treating a leather with a treating agent comprising 100 parts by weight of a copolymer (I) comprising as the principal components (A) an ethylenically unsaturated hydrocarbon compound having 3 to 20 carbon atoms or a halogen-substituted derivative thereof and (B) a monoethylenically unsaturated ester compound having 4 to 22 carbon atoms and 0.1 to 100 parts by weight of a polymer (II) selected from the group consisting of a polyester, polycarbonate, polyether, polyacetal and a polymer or copolymer of at least one member selected from the group consisting of ethylene, propylene, isobutylene, pentene-1, 4-methylpentene-1, vinyl chloride, vinylidene chloride, butadiene, chloroprene, isoprene, styrene, α-methyl styrene, vinyl toluene, α-chlorostyrene, p-chlorostyrene, p-bromostyrene, methyl acrylate, butyl acrylate, stearyl acrylate, methyl methacrylate, butyl methacrylate, stearyl methacrylate, ethyl crotonate, diethyl itaconate, diethyl maleate, vinyl acetate, vinyl propionate, vinyl laurate, vinyl benzoate, vinyl chloroacetate, allyl acetate, methyl vinyl ether, 2-chloroethyl vinyl ether, acrylonitrile, and methacrylonitrile.

* * * * *